US007719381B2

(12) United States Patent
Talbot

(10) Patent No.: US 7,719,381 B2
(45) Date of Patent: May 18, 2010

(54) TRANSMISSION LINE BALUN FOR BROADBAND COMBINERS, SPLITTERS AND TRANSFORMERS

(75) Inventor: Robert D. Talbot, Pittsford, NY (US)

(73) Assignee: Harris Corporation, Melbourne, FL (US)

( * ) Notice: Subject to any disclaimer, the term of this patent is extended or adjusted under 35 U.S.C. 154(b) by 221 days.

(21) Appl. No.: 11/435,360

(22) Filed: May 16, 2006

(65) Prior Publication Data

US 2007/0268086 A1 Nov. 22, 2007

(51) Int. Cl.
*H01P 5/10* (2006.01)
*H01P 5/12* (2006.01)
*H01Q 9/16* (2006.01)

(52) U.S. Cl. ..... 333/26; 343/821

(58) Field of Classification Search ..... 333/26, 333/33, 35, 128, 204; 343/792, 821, 795, 343/859, 865

See application file for complete search history.

(56) References Cited

U.S. PATENT DOCUMENTS 2,966,640 A * 12/1960 Eiland, Jr. ..... 333/26
4,028,709 A 6/1977 Berkowitz et al.
4,032,850 A 6/1977 Hill
4,222,016 A * 9/1980 Stock et al. ..... 333/24 R
4,647,868 A * 3/1987 Mueller ..... 330/286
4,719,699 A 1/1988 Dash et al.
4,737,797 A 4/1988 Siwiak et al.
4,962,359 A 10/1990 Dunsmore
5,296,823 A 3/1994 Dietrich
5,945,890 A * 8/1999 McCorkle ..... 333/26
6,552,689 B2 4/2003 Shinichi

OTHER PUBLICATIONS

Ruban V.P., The Strobe Pulse Shaper Built on Stripline Shielded by Ferrite, "Ultrawideband and Ultrashort Impulse Signals", IEEE, Sep. 19-22, 2004, pp. 296-298.*
Anonymous, "Transmission Line Transformers," www.bytemark.com, Jun. 11, 2003, pp. 1-3.
PCT/US07/11652, Aug. 18, 2008, Talbot, Int'l Search Report.
PCT/US07/11652, Aug. 18, 2008, Talbot, Written Opinion.

* cited by examiner

*Primary Examiner*—Benny Lee
*Assistant Examiner*—Gerald Stevens
(74) *Attorney, Agent, or Firm*—Allen, Dyer, Doppelt, Milbrath & Gilchrist, P.A. Attorneys at Law

(57) ABSTRACT

A transmission line balun comprising a tubular ferrite having a longitudinal passageway concentrically positioned over a conductive sleeve having a longitudinal passageway. The end of a coax feeder is positioned in the longitudinal passageway of the sleeve and the sleeve is grounded at its proximal end to the shield of the coax cable. The sleeve buffers the effects of the parasitic line caused by using ferrite in a balun.

12 Claims, 4 Drawing Sheets

TRANSMISSION LINE BALUN FOR BROADBAND COMBINERS, SPLITTERS AND TRANSFORMERS

STATEMENT REGARDING FEDERALLY SPONSORED RESEARCH OR DEVELOPMENT

The United States Government has certain rights in and to this invention pursuant to Government Contract No. FA8709-04-C-0010.

BACKGROUND OF THE INVENTION

1. Field of The Invention

This invention relates to transmission line transformers. More particularly, this invention relates to broadband transmission line baluns.

2. Description of the Background Art

A balanced to unbalanced transformer, also called by its contraction "balun", essentially provides the same characteristics as an isolation transformer that transmits the energy from input to output by a transmission line mode instead of by flux linkages as in the case of conventional transformers.

Baluns allow a grounded source to drive an ungrounded load or a balanced load where the midpoint is grounded. Further, baluns allow phase reversal of the signal. Still further, if a positive signal is applied to its input, the positive output lead could be grounded. If the return current is forced to flow in the shield, then there is no radiated field from the transmission line because, from a point outside the line, both currents are located at the center of the line and cancel each other out. However, a field still exists between the center conductor and the shield.

Baluns in the form of a conductive sleeve, also known as bazooka baluns, are commonly used to match balanced antennas to unbalanced coax feeders. A prior art bazooka balun 10 is shown in FIG. 1 as comprising a conductive sleeve 12 of a quarter wavelength long that is positioned over the end 16 of a 75Ω cable 14 and shorted to the shield 18 of the cable 14 (i.e., its unbalanced line 20) only at its proximal end 22 to reflect an open circuit at its feed point 24 of its inner conductor 26. The balanced line 28 constituting the load Z may comprise, as shown, a half-wave dipole antenna 30. The conductive sleeve 12 may fit tightly around the existing outer plastic mantle 32.

Notably, the bazooka balun's sleeve 12 shorted to the shield 18 forms a second coaxial transmission line (i.e., the sleeve being the "shield" of the new line and the original "shield" being the inner conductor). In theory, a perfect lossless quarter wave transmission line would present an infinite impedance at the frequency where it is a quarter wavelength long. In practice, however, using a small-diameter sleeve positioned tightly over only the cable's existing outer plastic mantle as the dielectric spacer presents a low impedance. In contrast, a significantly higher impedance can be attained by using a dielectric tubular cylinder installed over the coaxial cable to which a larger-diameter sleeve is then installed. A representative patent showing a larger-diameter sleeve includes U.S. Pat. No. 4,737,797, the disclosure of which is hereby incorporated by reference herein. U.S. Pat. No. 6,552,689, the disclosure of which is hereby incorporated by reference herein, discloses a balun in which a conductive sleeve and a dielectric cylinder of the same diameter are stacked and then positioned within a larger-diameter outer dielectric cylinder.

The impedance and the lower frequency end of the bandwidth may be increased through the use of baluns that employ ferrites in lieu of sleeves. Without the use of ferrite, the inductance of the shield to ground limits the low frequency end.

Prior art ferrite baluns employing ferrite beads have often comprised a plurality of ferrite beads positioned over the cable close to the feed point to maintain a high impedance across the frequency band. See for example, U.S. Pat. No. 4,962,359, the disclosure of which is hereby incorporated by reference herein. Other prior art ferrite baluns have employed ferrite sleeves. See for example, U.S. Pat. No. 4,719,699, the disclosure of which is hereby incorporated by reference herein. Finally, still other ferrite baluns have been incorporated into the frame of a Yagi antenna. See for example, U.S. Pat. No. 4,028,709, the disclosure of which is hereby incorporated by reference herein.

Unfortunately, when using ferrite baluns, a parasitic line is formed by the shield to ground. The parasitic effects of employing ferrite at high frequencies is well documented. U.S. Pat. No. 5,296,823, the disclosure of which is hereby incorporated by reference herein, acknowledges such parasitic effects and teaches specific printed circuit and shielded structures for parasitic mode suppression. Specifically, as illustrated in FIG. 11 thereof, one shielded structure includes the side-by-side positioning of a ferrite core having a central passage containing a two-conductor transmission line and a dielectric having a central passage containing a single-conductor transmission line, into an enlarged shielding tubular signal ground conductor. According to its teachings, the shielded structure confines signal energy and prevents coupling to other outside circuits and structures.

There presently exists a need for an improved balun that isolates the balun from the effects of ferrite at low frequencies, thereby significantly reducing losses and improving voltage standing wave ratio (VSWR).

Therefore, it is an object of this invention to provide an improvement which overcomes the aforementioned inadequacies of the prior art devices and provides an improvement which is a significant contribution to the advancement of the balun art.

Another object of this invention is to provide a balun that employs a ferrite to increase the impedance and the lower frequency end of the bandwidth while isolating the balun from the parasitic effects of ferrite at low frequency and thereby significantly reducing losses and improving VSWR.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing the invention, the invention comprises a transmission line balun for broadband combiners, splitters and transformers. In general, the balun of the invention comprises a tubular ferrite having a longitudinal passageway. A conductive sleeve is positioned concentrically within the passageway of the tubular ferrite. The length of the tubular ferrite containing the conductive sleeve and the length of the conductive sleeve are both preferably one-quarter of the wavelength. The distal end of the transmission line is positioned into the conductive sleeve and the sleeve is grounded at its proximal end to the shield of the coax. The resulting assembly comprises the coax, the conductive sleeve and the tubular ferrite positioned concentrically with respect to each other at the proximal end of the coax.

More specifically, the balun of the invention comprises a coax cable, with a conducting sleeve surrounding it, and a ferrite sleeve over the conducting sleeve. The sleeves are separated by insulating material. The conducting sleeve is connected to the transmission line at one end.

In order to the test the concept of the invention, an implementation of the invention, as represented in the data hereinafter set forth, was constructed comprising two 50 ohm unbalanced to balanced 50 ohm units connected back-to-back. The test implementation used a 25 ohm semi rigid 0.07 diameter coax connected in series at the input and output of the back-to-back assembly. The conductive sleeve was positioned on the outside shield of a semi-rigid 50 ohm coax. Two ferrite cores with a permeability (μ) of 40, each having an inside diameter of 0.281 inches and an outside diameter of 0.50 inches, were placed over the shield.

It is noted that if the coax length were a half wavelength long, the short at the source end appears at the load end and would destroy the balun operation. Therefore, the length of the balun should normally be under a half wavelength long. However, disadvantageously, this requirement would severely limit the low frequency response. Thus, in order to expand the low frequency operation, the ferrite according to the invention was used around the coax.

The use of the ferrite according to the invention results in the parasitic line being electrically longer than the coax because the transmission medium for the parasitic line is through the magnetic material which has a high permeability and dielectric constant. Use of the conducting sleeve of the invention significantly diminishes this effect.

It is noted that further testing indicated that if the sleeve of the invention was not employed, large dips in its response were suffered. It is believed that the large dips in the response in the assembly without the sleeve were due to the parasitic line formed by the shield of the coax and ground using the ferrite core as part of the medium for the parasitic line. A representative VSWR without the use of the sleeve of the invention is shown in FIG. 2.

In summary, according to the present invention, the use of the conductive sleeve encompassing a tubular ferrite isolates the balun from the effects of ferrite at low frequency and thereby significantly reduces losses and improves VSWR. Many of the disadvantages associated with prior art ferrite baluns are therefore overcome.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other circuits and assemblies for carrying out the same purposes of the present invention. It should also be realized by those skilled in the art that such equivalent circuits and assemblies do not depart from the spirit and scope of the invention as set forth in the appended claims.

BRIEF DESCRIPTION OF THE DRAWINGS

For a fuller understanding of the nature and objects of the invention, reference should be had to the following detailed description of the preferred embodiment taken in connection with the accompanying drawings in which.

Similar reference characters refer to similar parts throughout the several views of the drawings.

DETAILED DESCRIPTION OF THE PREFERRED EMBODIMENT

Figure 1:
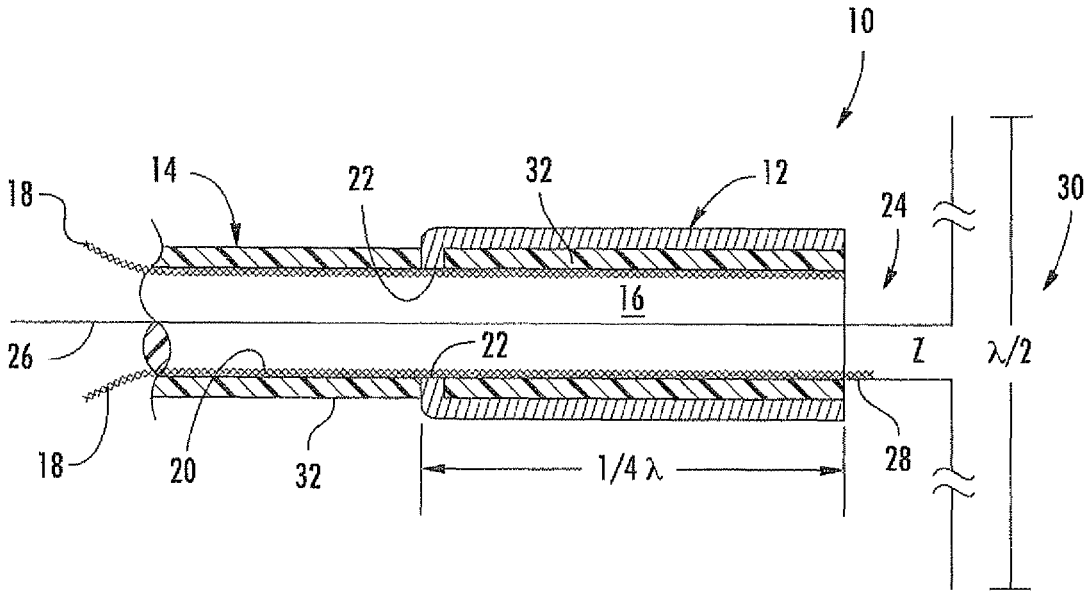
FIG. 1 PRIOR ART
FIG. 1 is a longitudinal cross-sectional view of a prior art bazooka balun employing a sleeve.
Figure 2:
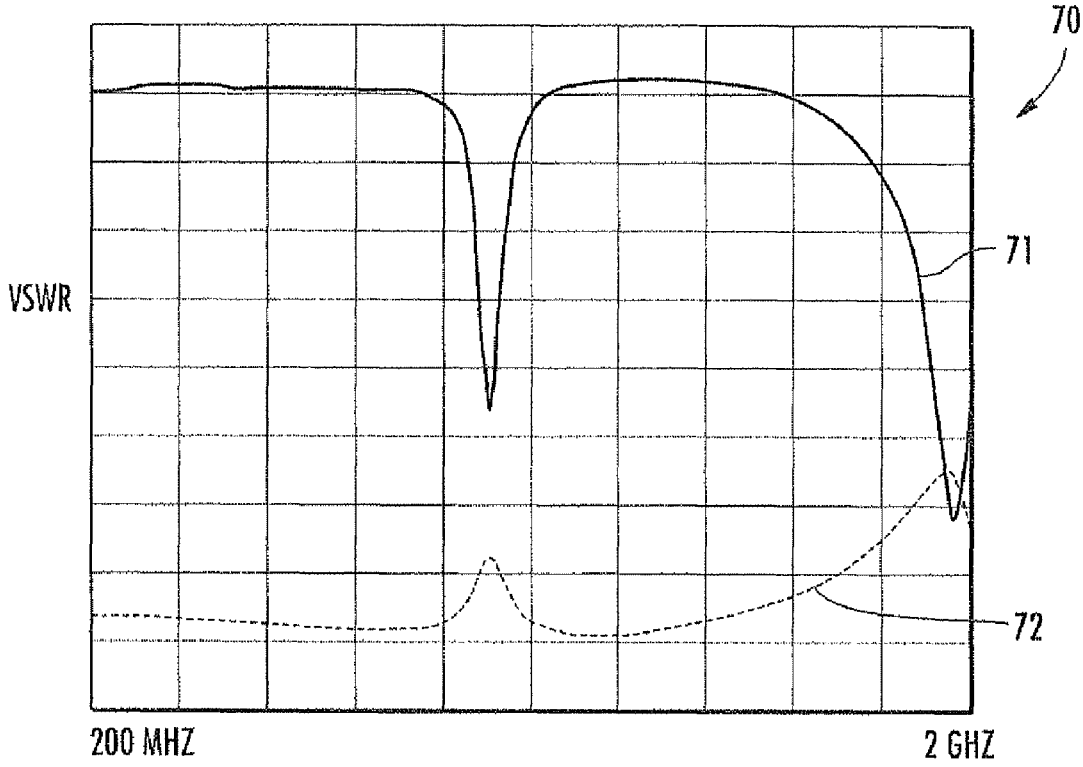
FIG. 2 PRIOR ART
FIG. 2 is a VSWR plot of a typical prior art ferrite balun.
Figure 3:
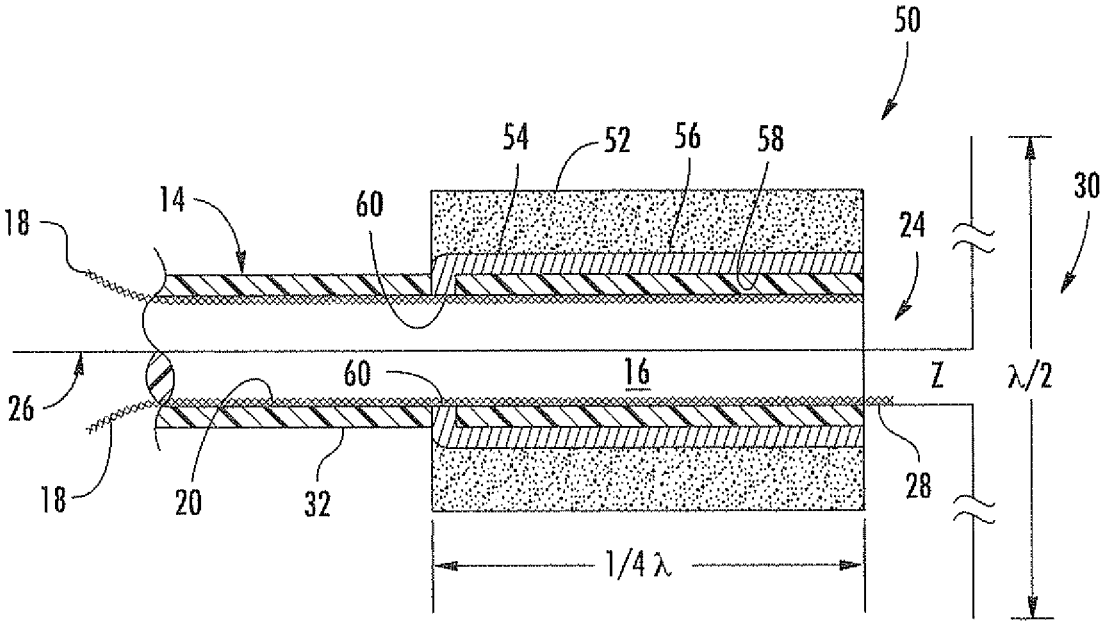
FIG. 3 is a longitudinal cross-sectional view of a balun according to the present invention that employs a conductive sleeve encompassing a tubular ferrite installed over the terminal end of a coax feeder.
Figure 4:
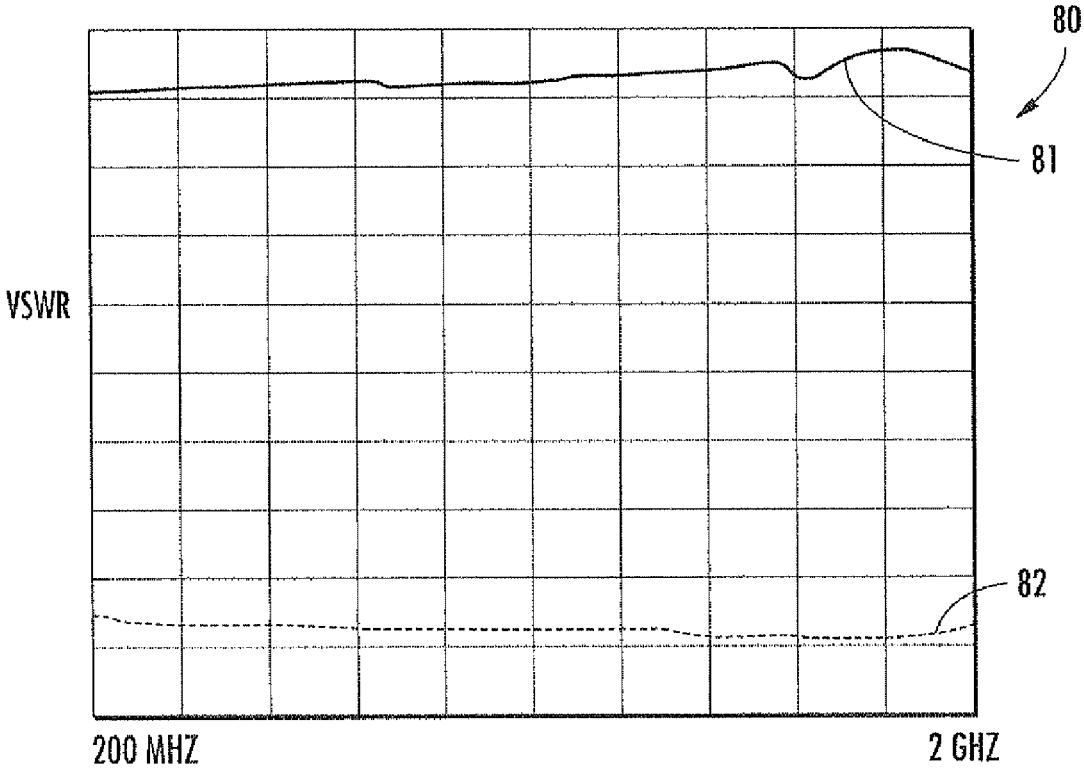
FIG. 4 is a VSWR plot of the balun of FIG. 3.

Referring to FIG. 3, the preferred embodiment of the balun 50 of the invention comprises a tubular ferrite 52 having a longitudinal passageway 54 concentrically positioned over a conductive sleeve 56 having a longitudinal 58 passageway. The proximal end 60 of the conductive sleeve 56 is preferably inwardly turned. Preferably, the tubular ferrite 52 and the conductive sleeve 56, along with their respective passageways 54 and 58, comprise circular cylindrical configurations.

In one application, the balun 50 of the invention is intended to be coupled over the end 16 of a 75Ω cable 14 and the conductive sleeve 56 shorted to the shield 18 of the cable 14 (i.e., its unbalanced line 20) only at its proximal end 60, such as by soldering, to reflect an open circuit at its feed point 24 of the cable's inner conductor 26.

The coupled conductive sleeve 56 forms a parasitic line from the shield 18 of the coax cable 14. The tubular ferrite 52 coupled to the sleeve 18 forms an additional parasitic line between the sleeve 56 and ground. The effect of the parasitic line which uses the ferrite 52 for its medium is buffered by the sleeve 56. When the parasitic line formed by the sleeve 56 and the shield 18 is a quarter wavelength, the impedance between the unbalanced line 20 and the end of the sleeve 56 is very high, thereby reducing the effect of the impedance from the end of the sleeve to ground.

The longitudinal passageway 58 of the conductive sleeve 56 may be dimensioned to fit tightly around the existing outer plastic mantle 32 of the cable 14. Alternatively, the mantle 32 may be removed and the longitudinal passageway 58 of the conductive sleeve 56 may be dimensioned to fit tightly around the shield 18 of the cable 14. Still alternatively, the mantle 32 may be replaced by or supplemented with a thicker dielectric spacer, with the diameter of the longitudinal passageway 58 of the conductive sleeve 56, and of the tubular ferrite 52, correspondingly increased.

The tubular ferrite 52 may dimensioned such that its longitudinal passageway 54 fits tightly around the conductive sleeve 56. Alternatively, the diameter of the longitudinal passageway 54 of the tubular ferrite 53 may be greater than the outer diameter of the conductive sleeve 56 to form a space therebetween, that itself may be filled with a dielectric spacer.

The wall thickness of the ferrite 52 and its permeability and the space between the ferrite 52 should be selected to optimize the performance of the balun. The following chart sets forth an example of an actual prototype:

| | |
|---|---|
| Tubular Ferrite Material | Ferronic-P<br>Part Number 11-761P |
| Permeability of Tubular Ferrite | 40 |
| Diameter of Longitudinal Passageway of Tubular Ferrite (Inside Diameter of Core) | 0.281 inch |
| Wall Thickness of Tubular Ferrite | 0.105 inch |
| Outside Diameter of Tubular Ferrite | 0.50 inch |
| Spacing Between Outer Diameter of Sleeve and Diameter of Longitudinal Passageway of Tubular Ferrite (Inside Diameter of Core) | 0.065 inch |

The balun 50 of the invention is principally intended to function as a balanced/unbalanced transformer for a load Z. For example, the balanced line 28 constituting the balun's load Z may comprise, as shown in FIG. 3, a half-wave dipole antenna 30. Alternatively, without departing from the spirit and scope of the invention, the balun 50 may be configured as a splitter or a combiner.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A balun comprising:

a transmission line;

an electrically conductive shield surrounding said transmission line;

an electrically conductive sleeve surrounding said electrically conductive shield and forming a first parasitic line with said electrically conductive shield; and a ferrite body surrounding said electrically conductive sleeve and forming a second parasitic line between said electrically conductive sleeve and a reference voltage;

said electrically conductive sleeve being electrically coupled to said electrically conductive shield and isolating the balun from effects of said ferrite body at low frequencies, thereby reducing losses and improving voltage standing wave ratio (VSWR).

2. The balun according to claim 1 wherein said ferrite body comprises a tubular ferrite body having a longitudinal passageway therein; and wherein said electrically conductive sleeve is positioned in the longitudinal passageway.

3. The balun according to claim 2 wherein said longitudinal passageway comprises a cylindrical longitudinal passageway; and wherein said electrically conductive sleeve comprises a tubular electrically conductive sleeve.

4. A balun comprising:

a transmission line;

a shield surrounding said transmission line;

an electrically conductive sleeve surrounding said shield and forming a first parasitic line with said shield; and a ferrite body surrounding said electrically conductive sleeve and forming a second parasitic line between said electrically conductive sleeve and a reference voltage;

said electrically conductive sleeve being electrically coupled to said shield and isolating the balun from effects of said ferrite body at low frequencies, thereby reducing losses and improving voltage standing wave ratio (VSWR).

5. The balun according to claim 4 wherein said ferrite body comprises a tubular ferrite body having a longitudinal passageway therein; and wherein said electrically conductive sleeve is positioned in the longitudinal passageway.

6. The balun according to claim 5 wherein said longitudinal passageway comprises a cylindrical longitudinal passageway; and wherein said electrically conductive sleeve comprises a tubular electrically conductive sleeve.

7. The balun according to claim 4 wherein the reference voltage comprises a ground voltage.

8. A method for making a balun comprising:

surrounding a transmission line with a shield;

positioning an electrically conductive sleeve to surround the shield and to form a first parasitic line with the shield;

positioning a ferrite body to surround the electrically conductive sleeve and to form a second parasitic line between the electrically conductive sleeve and a reference voltage;

electrically coupling the electrically conductive sleeve with the shield for buffering parasitic effects formed by coupling the ferrite body to the transmission line; and using the electrically conductive sleeve in cooperation with the ferrite body to isolate the balun from the effects of the ferrite body at a low frequency, thereby reducing losses and improving voltage standing wave ratio (VSWR).

9. The method according to claim 8 further comprising forming the ferrite body to comprise a tubular ferrite body having a longitudinal passageway therein, and positioning the electrically conductive sleeve in the longitudinal passageway.

10. The method according to claim 9 wherein the forming of the ferrite body comprises forming the ferrite body to comprise the tubular ferrite body having a cylindrical longitudinal passageway; and wherein the electrically conductive sleeve comprises a tubular electrically conductive sleeve.

11. The method according to claim 8 wherein the positioning of the ferrite body to surround the electrically conductive sleeve comprises positioning a quarter length ferrite body to surround a quarter length electrically conductive sleeve.

12. The method according to claim 8 further comprising using the transmission line to define a portion of a transformer.

* * * * *